US008523485B2

(12) United States Patent
Higginson

(10) Patent No.: US 8,523,485 B2
(45) Date of Patent: Sep. 3, 2013

(54) FLOTATION STRUCTURE FOR BUOYANT FLOOD PROTECTION BARRIER AND BARRIER INCORPORATING, SUCH A STRUCTURE

(76) Inventor: Simon John Higginson, Burcott (GB)

( * ) Notice: Subject to any disclaimer, the term of this patent is extended or adjusted under 35 U.S.C. 154(b) by 266 days.

(21) Appl. No.: 12/735,896

(22) PCT Filed: Jan. 26, 2009

(86) PCT No.: PCT/GB2009/000213

§ 371 (c)(1),
(2), (4) Date: Aug. 24, 2010

(87) PCT Pub. No.: WO2009/109735

PCT Pub. Date: Sep. 11, 2009

(65) Prior Publication Data

US 2010/0322712 A1 Dec. 23, 2010

(30) Foreign Application Priority Data

Mar. 1, 2008 (GB) ..... 0803927.3

(51) Int. Cl.
*E02B 3/10* (2006.01)

(52) U.S. Cl.
USPC ..... 405/115; 405/60; 405/63; 405/211

(58) Field of Classification Search
USPC ..... 405/107, 114, 115, 110, 63, 65, 66, 405/70, 71; 52/109; 441/44, 50
See application file for complete search history.

(56) References Cited

U.S. PATENT DOCUMENTS

| | | | | |
|---|---|---|---|---|
| 1,222,200 | A * | 4/1917 | Grandinetti | 182/148 |
| 4,373,834 | A * | 2/1983 | Grace | 405/60 |
| 5,154,537 | A * | 10/1992 | DeVries et al. | 405/211 |
| 6,554,534 | B1 * | 4/2003 | Butterfield | 405/63 |
| 2007/0237586 | A1 * | 10/2007 | Prestininzi | 405/115 |
| 2007/0267559 | A1 * | 11/2007 | Spearing et al. | 248/354.1 |

FOREIGN PATENT DOCUMENTS

| | | |
|---|---|---|
| DE | 202 13 219 U1 | 12/2002 |
| GB | 2 397 086 A | 7/2004 |
| GB | 2 435 664 A | 12/2007 |
| WO | WO 98/12388 A | 3/1998 |

* cited by examiner

*Primary Examiner* — Sean Andrish
*Assistant Examiner* — Carib Oquendo
(74) *Attorney, Agent, or Firm* — Ira S. Dorman

(57) ABSTRACT

A flotation structure for a buoyant flood protection barrier includes a flotation body (1) adapted to rise and fall with flood water. A flexible membrane (3) is sealed at an upper region to the flotation body and sealed at a lower region. A plurality of panels (5) are hinged by means of hinge pins about substantially parallel horizontal axes, a topmost panel being hinged to the flotation body, a lowermost panel being hinged substantially at ground level, and intervening panels being hinged to each other. A scissor arrangement (9) is pivotably mounted at an upper end to the flotation body and pivotably mounted at a lower end and provided with a pivot pin (17) at a crossing point of arms (11, 13) of the scissor arrangement, the pivot pin being secured to a member (19) provided on at least one of the hinge pins (23). A buoyant flood protection barrier includes at least two such flotation structures and a plurality of flexible rods (25) extending between the end of one flotation structure and the end of an adjacent flotation structure for supporting the membrane (3) between the two flotation structures.

13 Claims, 6 Drawing Sheets

FLOTATION STRUCTURE FOR BUOYANT FLOOD PROTECTION BARRIER AND BARRIER INCORPORATING, SUCH A STRUCTURE

CROSS-REFERENCE TO RELATED APPLICATION

This application claims the benefit of prior Application No. GB 0803927.3, filed 1 Mar. 2008.

BACKGROUND OF THE INVENTION

This invention relates to a flotation structure for a buoyant flood protection barrier. The invention also relates to a buoyant flood protection barrier incorporating such a flotation structure.

A buoyant flood protection barrier is known, for example, from GB-A-2 397 086 and comprises flotation structure including a flotation body to which is secured a flexible, waterproof barrier. The flotation body is provided with guide wheels which run in guide rails which are positioned around a property to be protected.

One problem that arises with the known flotation structure is that the flexible panels do not always open in an ideal manner, which can lead to distortion and jamming of the hinged panels.

BRIEF SUMMARY OF THE INVENTION

It is therefore an object of the present invention to provide a flotation structure for a buoyant flood protection barrier which overcomes or at least ameliorates the abovementioned disadvantage.

According to one aspect of the present invention there is provided a flotation structure for a buoyant flood protection barrier comprising:

a flotation body adapted to rise and fall with flood water;

a flexible membrane sealed at an upper region thereof to the flotation body and sealed at a lower region thereof;

a plurality of panels hinged by means of hinge pins about substantially parallel horizontal axes, a topmost panel being hinged to the flotation body, a lowermost panel being hinged substantially at ground level, and intervening panels being hinged to each other; and a scissor arrangement pivotably mounted at an upper end to the flotation body and pivotably mounted at a lower end and provided with a pivot pin at a crossing point of arms of the scissor arrangement, the pivot pin being secured to a member provided on at least one of the hinge pins.

The length of the arms of the scissor arrangement may be selected such that the arms cross at a point adjacent to each of the horizontal axes which is adjacent to the scissor arrangement. One or more intermediate crossing points may be provided if desired.

The member provided on at least one of the hinge pins may be rotatable about the hinge pin and/or may be slidable along the hinge pin.

The flotation structure may include one or more support posts provided on that side of the panels remote from the membrane. The support posts may be movable upwardly and downwardly in a sleeve set in the ground. A lower end of the or each support post may be provided with at least one roller adapted to bear against an inner surface of the sleeve. A plurality of rollers may be provided, spaced around the periphery of the support post. An upper end of the sleeve may be provided with at least one roller adapted to bear against an outer surface of the support post. A plurality of rollers may be provided, spaced around the periphery of the sleeve.

According to another aspect of the present invention there is provided a buoyant flood protection barrier comprising at least two flotation structures as hereinbefore defined and including a plurality of flexible rods extending between the end of one flotation structure and the end of an adjacent flotation structure for supporting the membrane between the two flotation structures.

The flexible rods may be connected to the outer region of the flotation structures.

The flexible rods may be arranged to be connected to the two flotation structures at different levels. When connected to the outer regions of the hinged panels the angle of the rods changes relative to the horizontal as the barrier is raised and lowered.

For a better understanding of the present invention and to show more clearly how it may be carried into effect reference will now be made, by way of example, to the accompanying drawings in which:

DETAILED DESCRIPTION OF THE INVENTION

Figure 1:
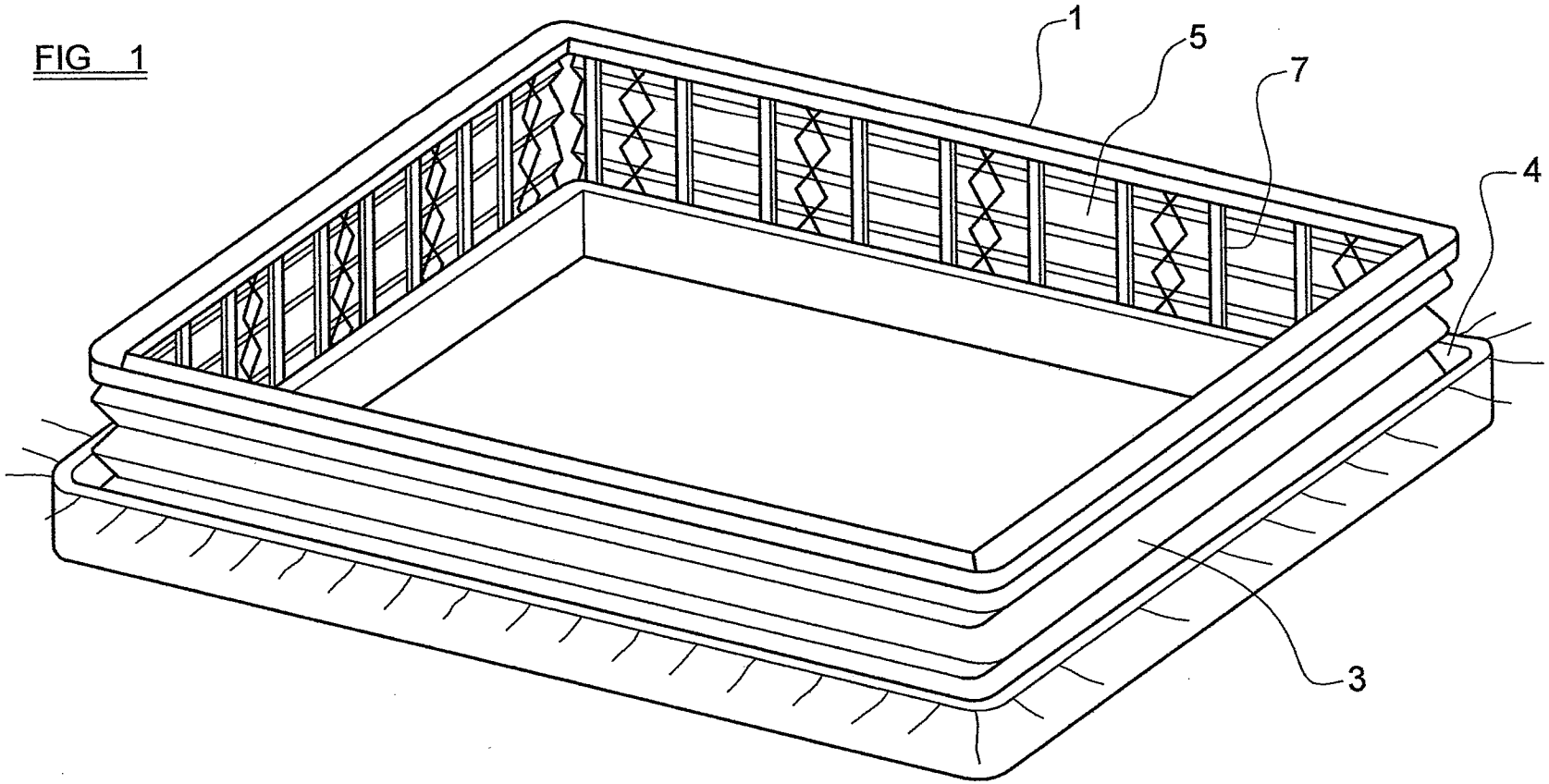
FIG. 1 is a perspective view of one embodiment of a flotation structure for a buoyant flood protection barrier according to the present invention.

FIG. 1 shows a flotation structure for a buoyant flood protection barrier which includes an elongate flotation body 1 which is adapted to rise and fall, floating on the surface of the water, as flood levels rise and fall. Attached to the bottom of the flotation body 1 is a flexible, waterproof membrane 3, the membrane being sealed in the upper region thereof to the flotation body 1 and at the lower region thereof around a property or area to be protected. For example, the membrane 3 may be sealed to a housing (or trench) 4 in which the flotation structure is stored when not in use. The membrane 3 extends entirely around the outer perimeter of the barrier and is supported by a plurality of substantially rigid panels 5 which are hinged about substantially parallel horizontal axes. The topmost panel 5 is hinged to the flotation body 1, the lowermost panel is hinged substantially at ground level, and the intervening panels are hinged to each other. The panels in turn are supported against a plurality of support posts 7 to reduce deflection of the panels.

Figure 2:
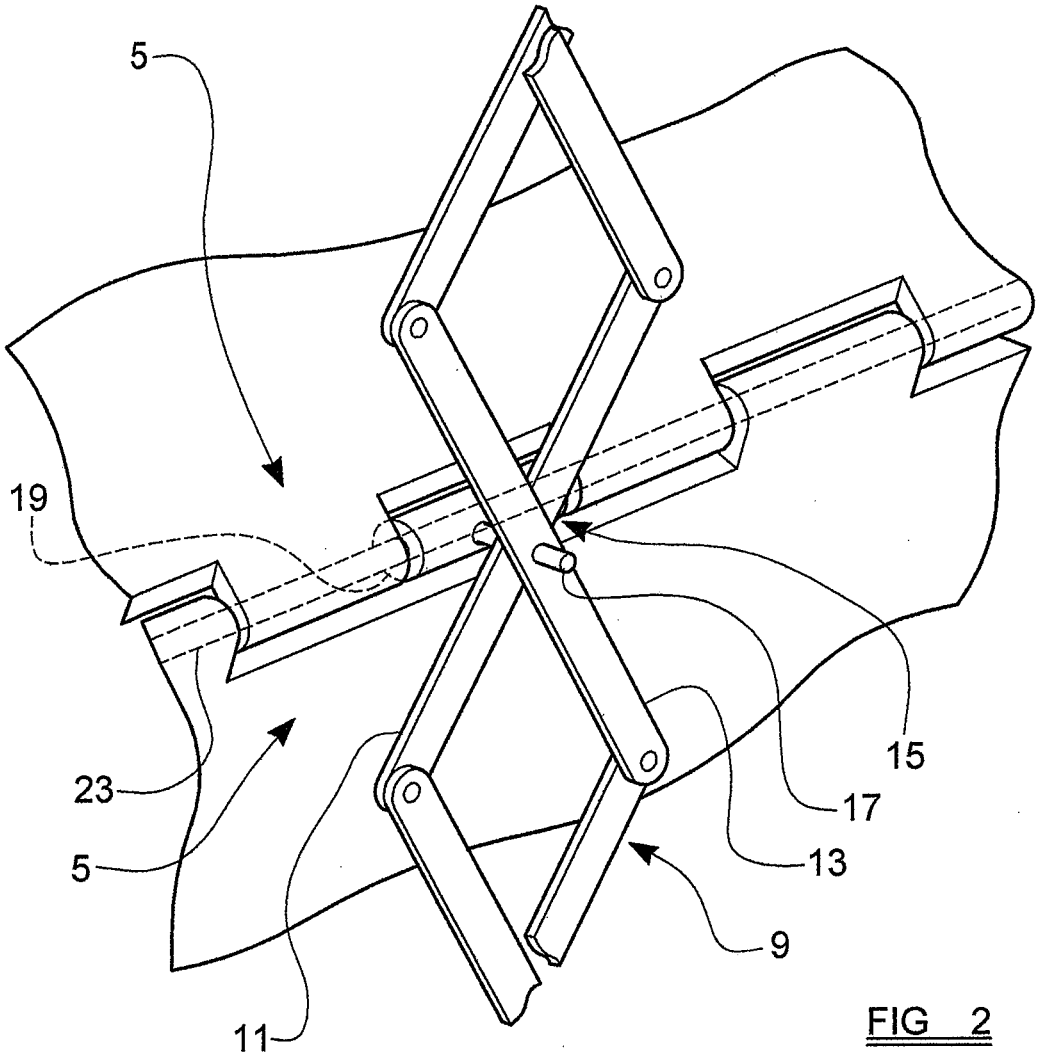
FIGS. 2 and 3 show part of the flotation structure shown in FIG. 1, but to a larger scale.
Figure 3:
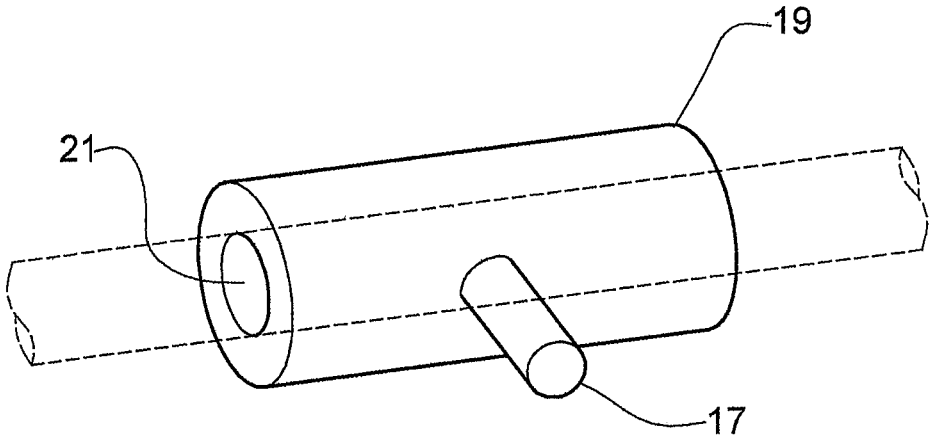
Figure 4:
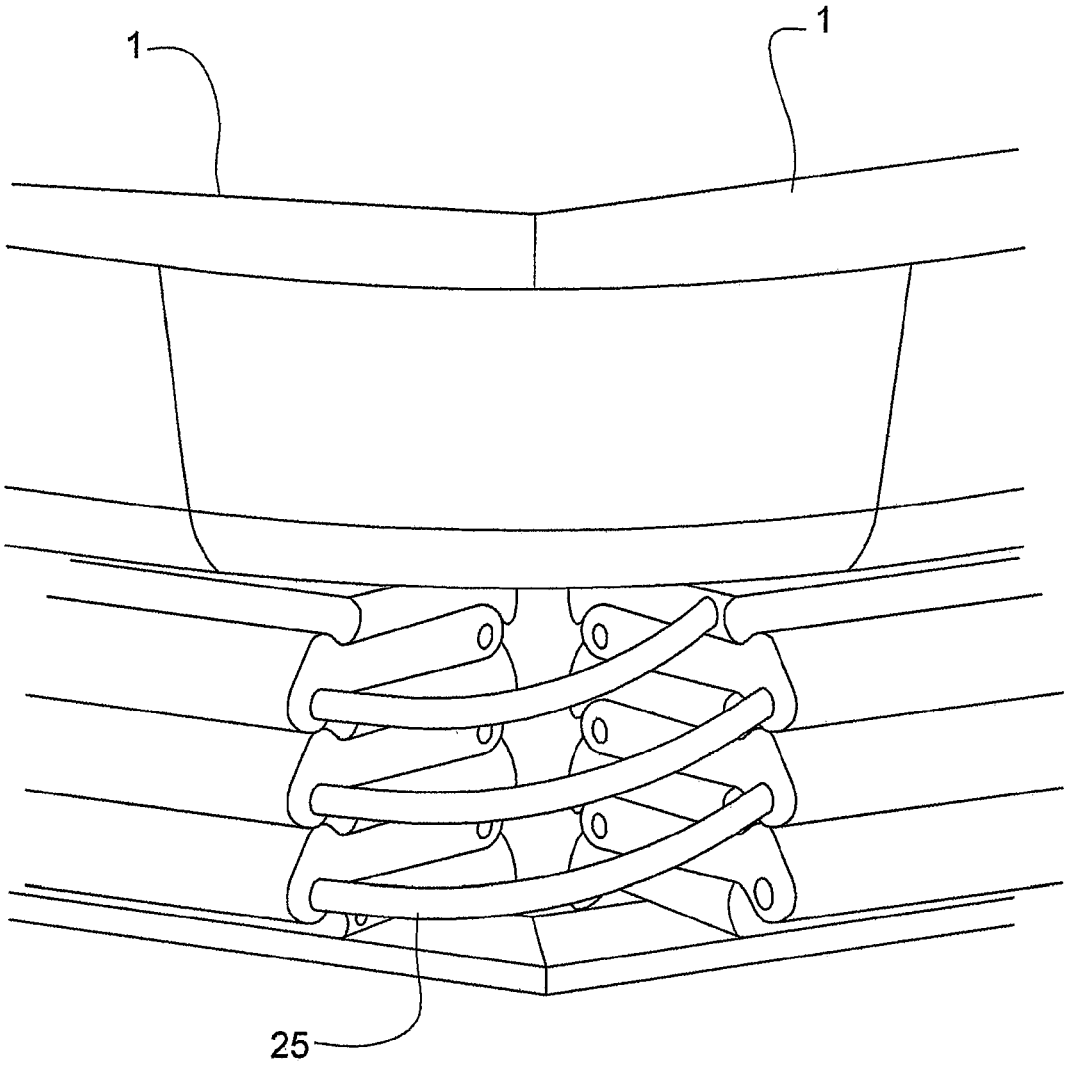
FIG. 4 is a perspective view showing a corner arrangement of a buoyant flood protection barrier incorporating flotation structures shown in FIG. 1.

FIGS. 2 and 3 illustrate in more detail a mechanism for ensuring even opening of the hinged panels 5. A scissor arrangement 9 is positioned alongside the panels 5 and rises and falls with the panels. Arms 11, 13 of the scissor arrangement are pivotably mounted at the upper end of the arrangement to the flotation body 1 and are pivotably mounted at the lower end substantially at the level of the bottom of the membrane 3 (which may be below ground level in housing 4. The length of the arms 11, 13 is selected such that the arms cross at a point 15 adjacent to each of the axes about which the panels pivot relative to each other and which is adjacent to the scissor arrangement, although one or more intermediate crossing points may be provided if desired to avoid the use of arms of excessive length. That is, the panels 5 are each hinged to one another, with the result that when folded, or partially folded, the hinge between one pair of panels will be adjacent to the scissor arrangement 9, while the adjacent hinge will move progressively away from the scissor arrangement as the panels are folded and will move progressively towards the scissor arrangement as the panels are unfolded.

Each crossing point 15 is also a pivot point for the arms 11, 13 and a pivot pin 17 is secured to or formed integrally with a panel support member 19. The panel support member extends in the axial direction of the hinge between two panels 5 and is generally cylindrical in shape, while the axis of the pivot pin 17 is substantially perpendicular to the axis of the member 19. The member 19 is formed with a bore 21 and is mounted on a hinge pin 23 which secures adjacent panel members together. The panel support member 19 is preferably rotatable about the hinge pin 23 and slidable along the hinge pin to accommodate any relative movement between the panels 5 and the scissor arrangement 9.

As the flotation body 1 rises it pulls both the panels 5 and the scissor arrangement 9 upwardly. However, the scissor arrangement ensures that the hinge pins 23 are all spaced apart by the same distance, thereby minimising buckling and the risk of jamming of the panels. The equal spacing is also maintained as the flotation body falls.

Figure 5:
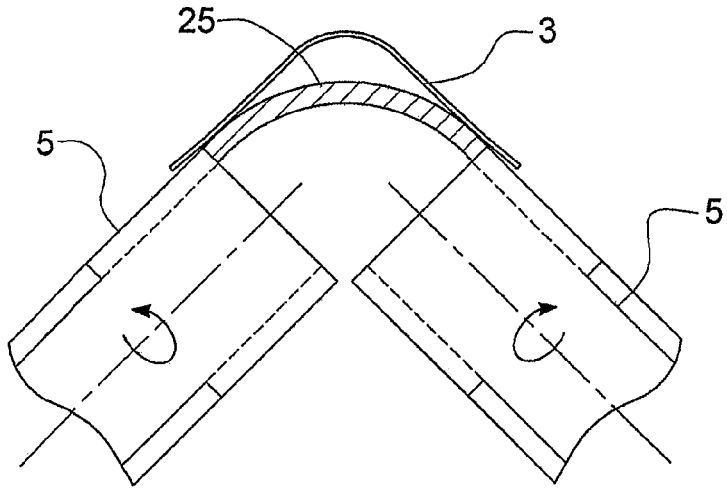
FIGS. 5 to 7 are plan views of the corner arrangement shown in FIG. 4.
Figure 6:
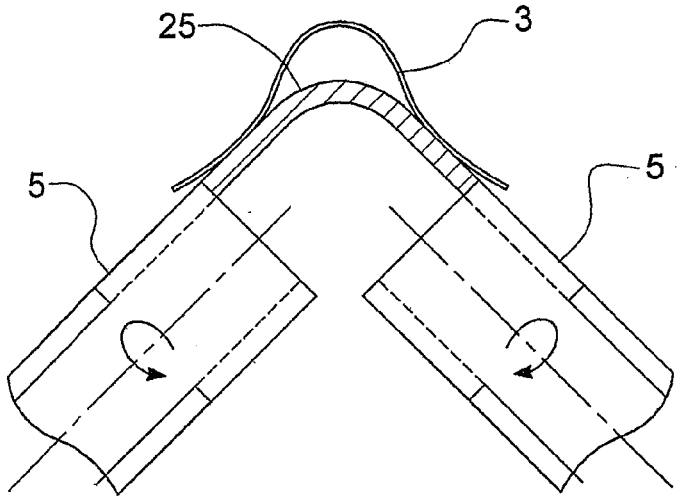
Figure 7:
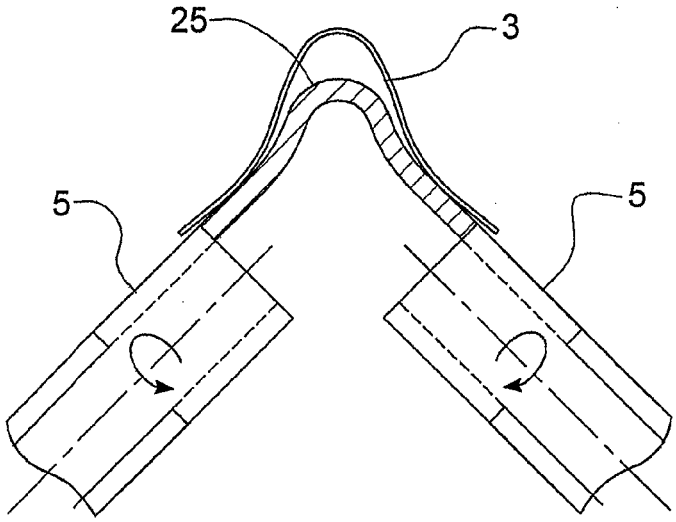

FIGS. 4 to 7 illustrate the manner in which corners of a buoyant flood protection barrier comprising two flotation structures are bridged by the membrane 3. Without any physical support, the membrane 3 (only part of which is shown in FIGS. 5 to 7) would bulge inwardly between the ends of each flotation structure and could tear or become trapped and be damaged. To prevent this, a plurality of rods 25 flexible material, for example a flexible or resilient synthetic material, extends at the outer edge of the flotation body 1 or a panel 5 from the end of one flotation structure to the end of an adjacent flotation structure. The rods 25 need not extend substantially horizontally, but instead may be arranged at an angle to the horizontal whereby each rod is secured at the end of a predetermined panel in one flotation structure and is secured one panel apart (up or down) at the end of an adjacent flotation structure.

As the barrier rises, the panels rotate, the effect of rotation being shown in FIGS. 5 to 7. Initially, with the panels 5 substantially horizontal, the rod 25 is substantially arcuate. However, as the barrier rises and the panels rotate, the rod 25 moves from a relatively horizontal configuration to a relatively upright configuration. At the same time, the ends of the rod move towards the inner hinge pins 23 at which the panels are supported relative to the scissor arrangement 9 (not shown in FIGS. 4 to 7). FIGS. 5, 6 and 7 show the barrier in progressively raised configurations. The combined effect of these two movements is to cause the middle region of the rod 25 to move outwardly from the corner between the two flotation structures. At the same time, because the distance around the perimeter of the barrier is decreasing (due to the inward movement of the panels) the membrane 3 becomes pinched by water pressure against the outside of the barrier, but is supported by the rods 25 and guided into "noses" or protrusions which are unable to collapse inwardly through any gap at the junction between the two flotation structures.

As the barrier falls, the rods 25 move back to a relatively horizontal configuration and take a more arcuate shape and continue to support the membrane 3 which assumes a more rounded shape across the gap between the two flotation structures.

Figure 8:
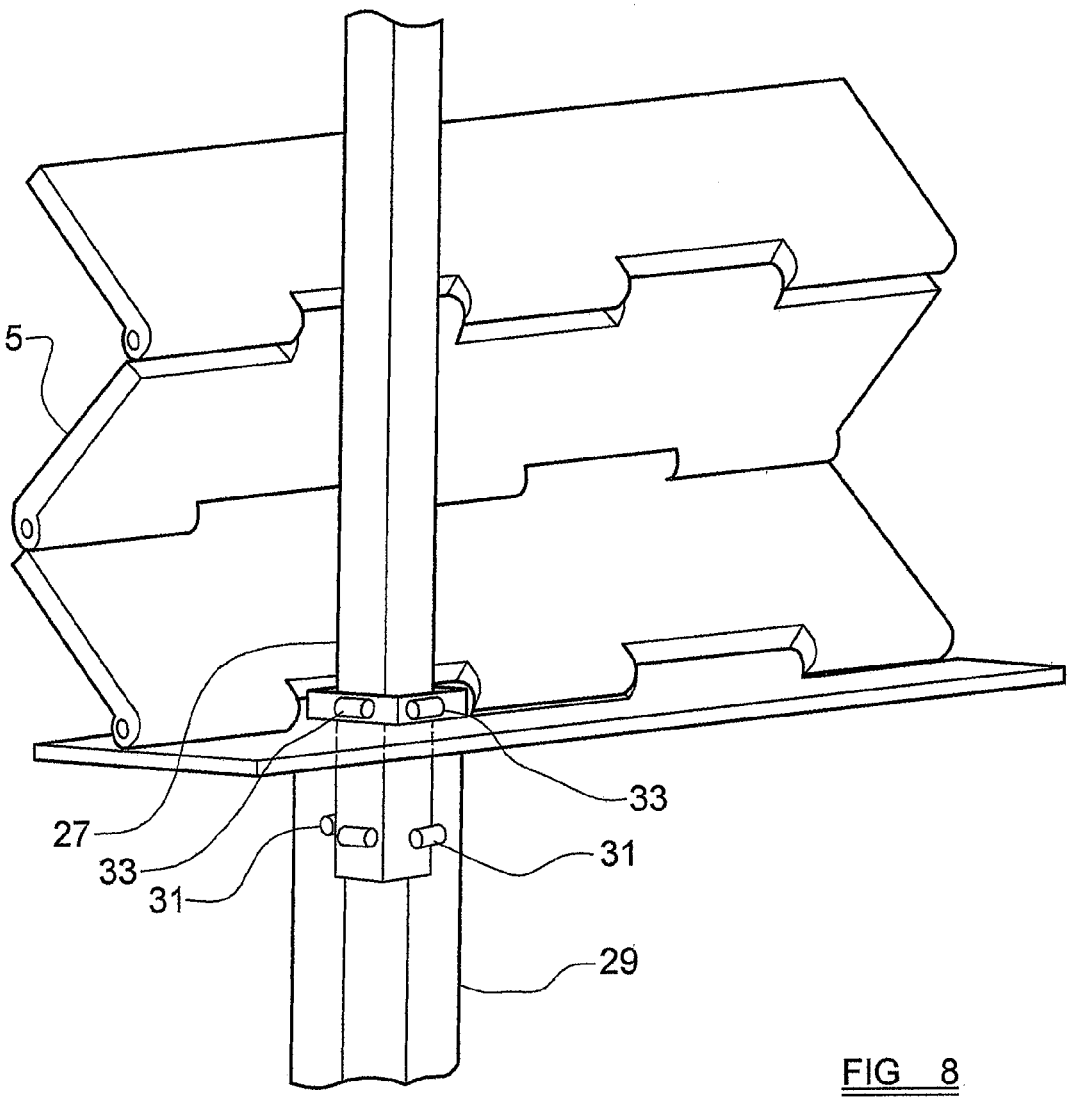
FIGS. 8 and 9 are diagrammatic perspective views illustrating support posts forming part of the flotation structure according to the present invention.
Figure 9:
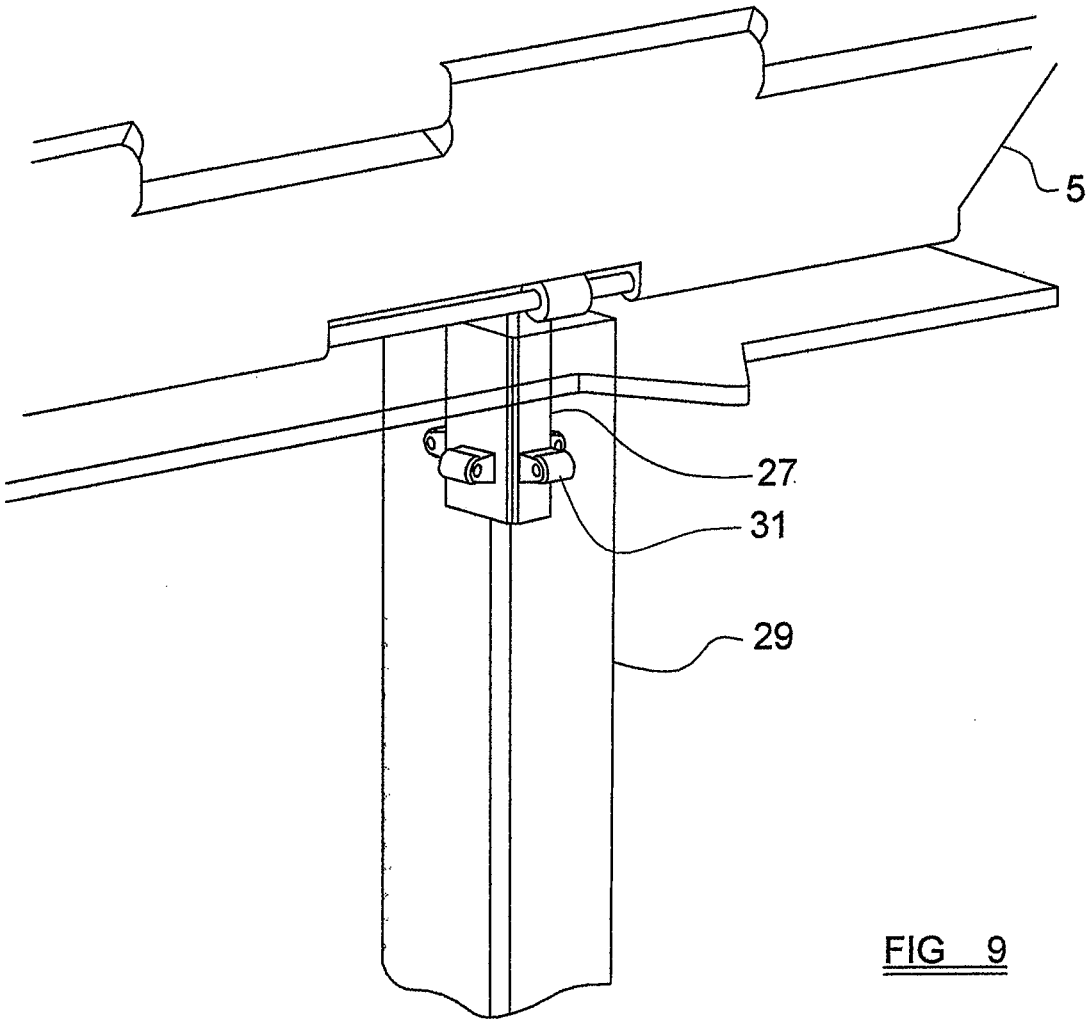

FIGS. 8 and 9 show a support post 27 which rises and falls with the flotation body 1. The figures show the arrangement from opposite sides of the flotation body. Support posts are positioned at intervals along the length of each flotation structure on the internal side of the flotation body and serve two primary functions. The support posts prevent the barrier as a whole being moved to and fro by any current that may be present in the flood water surrounding the barrier. In addition, the support posts provide support to the flotation structure and prevent or reduce inward bowing or other deformation due to water pressure. This is particularly a problem as the barrier extends towards its maximum height and the area of the barrier exposed to flood water increases, while the support attributable to the hinged panels 5 (which form a corrugated structure) diminishes.

Each support post 27 is mounted within a sleeve 29 which is set into the ground when the barrier is installed, the support post rising and falling within the sleeve as required. As illustrated, the support post is made of material of substantially square cross section. A plurality of outwardly extending rollers 31 are positioned around the lower end of the support post 27, for example four rollers, one on each face, so as to facilitate movement of the support post. In addition, as shown in FIG. 8, a plurality of inwardly extending rollers 33 are positioned around the upper end of the sleeve 29 so as to facilitate movement of the support post 27 relative to the upper end of the sleeve 29. In practice, the length of the support posts 27 will be determined by the anticipated maximum depth of any flood water.

Alternatively, a fixed support post 7 may be provided.

The invention claimed is:

1. A flotation structure for a buoyant flood protection barrier comprising:

a flotation body adapted to rise and fall with flood water;

a flexible membrane sealed at an upper region thereof to the flotation body and sealed to a housing at a lower region thereof; and a plurality of panels hinged by means of hinge pins about substantially parallel horizontal axes, a topmost panel being hinged to the flotation body, a lowermost panel being hinged to the housing substantially at ground level, and intervening panels being hinged to each other, wherein a scissor arrangement is pivotably mounted at an upper end to the flotation body and pivotably mounted at a lower end, arms of the scissor arrangement being selected such that the arms cross at a point adjacent to each of the axes about which the panels are hinged to each other and which is adjacent to the scissor arrangement, each said crossing point being pivotally connected by a pivot pin to a member provided on a respective hinge pin.

2. The structure of claim 1, wherein the arms of the scissor arrangement cross at one or more further intermediate crossing points.

3. The structure of claim 1, wherein the member provided on the respective hinge pin is rotatable about the respective hinge pin.

4. The structure of claim 1, wherein the member provided on at least one of the hinge pins is slidable along the at least one of the hinge pins.

5. The structure of claim 1, wherein the structure includes one or more support posts provided on a side of the panels remote from the membrane.

6. The structure of claim 5, wherein the one or more support posts are movable upwardly and downwardly in a sleeve in the ground.

7. The structure of claim 6, wherein a lower end of the or each support post is provided with at least one roller adapted to bear against an inner surface of the sleeve.

8. The structure of claim 7, wherein a plurality of rollers are provided, spaced around the periphery of the lower end of the support post.

9. The structure of claim 6, wherein an upper end of the sleeve is provided with at least one roller adapted to bear against an outer surface of the support post.

10. The structure of claim 9, wherein a plurality of rollers are provided, spaced around the periphery of the upper end of the sleeve.

11. A buoyant flood protection barrier comprising at least two flotation structures as claimed in claim 1 and including a plurality of flexible rods extending between an end of one flotation structure and an end of an adjacent flotation structure for supporting the membrane between the at least two flotation structures.

12. The barrier of claim 11, wherein the plurality of flexible rods are connected to an outer region of the at least two flotation structures.

13. The barrier of claim 11, wherein the plurality of flexible rods are arranged to be connected to the at least two flotation structures at different levels.

* * * * *